United States Patent [19]

Palm

[11] Patent Number: 4,537,100

[45] Date of Patent: Aug. 27, 1985

[54] PUSH-ON/QUICK RELEASE LOCKING ARRANGEMENT FOR SOCKET WRENCH EXTENSION

[76] Inventor: Bernhard Palm, 17420 Continental Dr., Brookfield, Wis. 53005

[21] Appl. No.: 584,512

[22] Filed: Feb. 28, 1984

[51] Int. Cl.[3] ..... B25B 13/00

[52] U.S. Cl. ..... 81/177.85; 403/325

[58] Field of Search ..... 81/177 G; 403/325, 328, 403/358, 361

[56] References Cited

U.S. PATENT DOCUMENTS

| | | | |
|---|---|---|---|
| 1,982,008 | 11/1934 | Mandl et al. | 81/177 G |
| 3,436,107 | 4/1969 | Karden | 403/361 X |
| 3,924,493 | 12/1975 | Penner | 81/177 G |
| 4,480,511 | 11/1984 | Nickipuck | 81/177 G |

FOREIGN PATENT DOCUMENTS

| | | | |
|---|---|---|---|
| 1115998 | 10/1961 | Fed. Rep. of Germany | 403/325 |

*Primary Examiner*—Frederick R. Schmidt
*Assistant Examiner*—Debra S. Meislin
*Attorney, Agent, or Firm*—Bayard H. Michael

[57] ABSTRACT

The socket wrench extension is provided with a push-on/quick release locking arrangement. The extension has a square drive end having a transverse bore in which the lock balls are mounted for movement between a lock position in which one ball projects from one end of the bore far enough to engage a cooperating cavity in the drive recess of a socket or other tool and a release position in which both balls lie within the cross section of the drive end. One end of the bore being closer to the drive end than the other end of said bore. An axially extending groove intersects the end of the bore further from the end of the extension. A sliding member moves between a lock position and a release position and has said lock tab engaging one of said balls when the member is in its lock position. The member has a limited range of movement enabling the lock tab to be raised above the groove by means of force applied to the tab by the balls. A spring biases the sliding member to its lock position and also biases the member to position the lock tab within the groove.

8 Claims, 7 Drawing Figures

PUSH-ON/QUICK RELEASE LOCKING ARRANGEMENT FOR SOCKET WRENCH EXTENSION

BACKGROUND OF THE INVENTION

The art prior to the invention shown in my copending application Ser. No. 06/502,763 filed June 9, 1983, did not provide an acceptable locking/quick release socket wrench extension.

Application Ser. No. 06/502,763 discloses a quick release locking arrangement for a socket wrench extension having a square drive end in which a transverse bore retains lock means for movement between a lock position in which the locking means projects from one end of the bore far enough to engage a cooperating cavity or undercut in the drive recess of a wrench socket (or other tool) and a release position in which the lock means lies within the cross section of the drive end and permits removal of the drive end from the socket. A lock tab is mounted for movement between a first position obstructing movement of the lock means to its release position and to a second position in which the lock means can move to the release position. The lock tab is a part of and controlled by a sleeve which is biased to hold the lock tab in the first position.

My prior invention required manual actuation of the sleeve to mount a socket on the extension. The design did not have "push-on" mounting capability.

SUMMARY OF THE INVENTION

This invention provides a socket wrench extension with a push-on/quick release locking arrangement. The extension has a square drive end and a transverse bore in said drive end. Lock means are mounted in said bore for movement between a lock position in which the lock means projects from one end of the bore far enough to engage a cooperating cavity in the drive recess of a tool and a release position in which the lock means lies within the cross section of the drive end. Said one end of the bore is closer to the end of said drive end than the other end of said bore. An axially extending groove intersects said other end of said bore, and a sliding member is mounted in the groove for movement between a lock position and a release position. The member has a lock tab about as thick as the depth of the groove so the tab can lie in the groove with the lock tab engaging the lock means. The sliding member has a limited range of pivotal movement enabling the lock tab to be raised above said groove by means of force applied to the tab by the lock means in its release position. The invention provides means biasing the member to its lock position and means biasing said member to position said lock tab within said groove.

The invention also provides a sleeve enclosing the spring which provides the bias function mentioned in the preceeding paragraph. The sleeve is connected to the sliding member.

The principal object of this invention is to improve upon my prior invention by way of providing for "push-on" mounting of a socket on an extension having a locking/quick release arrangement.

DETAILED DESCRIPTION OF THE DRAWINGS

Figure 7:
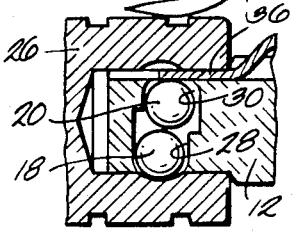
FIG. 7 is a partial section similar to FIG. 5 but showing an alternate way of making the cross bore.

The extension 10 has a solid round shaft 12 of the desired length. One end of the extension is provided with a recessed driven member (not shown) which is connected to and driven by the customary handle. The other end of the extension has a square driver 14 dimensioned to fit one of the standard socket sizes (such as $\frac{1}{4}''$, $\frac{3}{8}''$, $\frac{1}{2}\propto$, $\frac{3}{4}''$ or metrics). Driver 14 has a cross bore 16 in which two balls 18, 20 are retained by conventional coining operations at each end of the cross bore to reduce the opening to less than the ball diameter. As shown in FIGS. 3–6, the cross bore is at 11.5° to a line perpendicular to the axis of the extension. This positions ball 18 closer to the end of the extension so ball 18 will first engage the side 22 of a recess 24 in a socket 26 as the extension moves into the socket recess. As may be seen in FIG. 7, the cross bore can be made by drilling two offset holes to house balls 18, 20. The axis remains angled.

Figure 5:
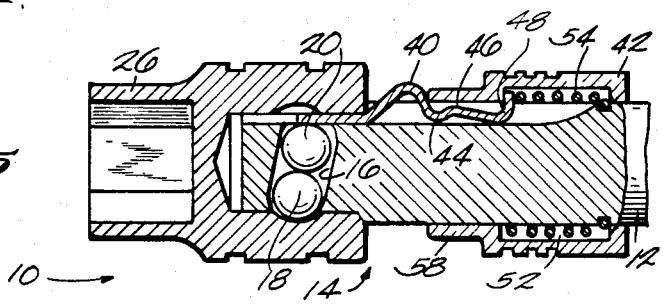
FIG. 5 is similar to FIG. 4, but the parts are now connected.

As viewed in the drawings, an axial groove 32 intersects the cross bore. The grooves lies in the middle of the flat drive face 34 and has a depth which when added to the length of the cross bore (measured from the bottom of the groove) is equal to the combined diameters of the two balls 18, 20. This permits the balls to lie wholly between the two opposed drive faces when the sliding member or slider 35 is moved to position the lock tab 36 in an unobstructing position. When the tab 36 is in the obstructing position shown in FIGS. 3 and 5, ball 18 further from the tab must project to a lock position beyond the flat face of the driver. When the driver is inserted into the recess of a wrench socket the projecting ball 18 will engage an undercut 38 in the recess 24 (as shown in FIG. 5) and the tab 36 will be backed up by the opposite wall of the recess to positively lock the socket in the extension until the lock tab 36 is manually withdrawn.

Slider 35 has a hump 40 which rises above and is engaged by the front end 58 of sleeve 42. Going further from the tab 36 the slider 35 has a downwardly formed boss 44 and an upwardly formed boss 46 spacing the slider in the groove. At the inner end the slider is bent upwardly to provide a pivot or point 48 about which the slider can rock. Arm 50 projecting upwardly from the point 48 projects into the groove 52 which houses spring 54 inside the sleeve 42. The right end of the spring has a tight coil received in a groove 56 in the extension so the other end of the spring bears against arm 50 and the forward wall of the groove 52. This biases the sleeve to the left and biases the slider about pivot 48 so tab 36 will normally lie in the groove 32. When the sleeve is pulled back (right) the tab 36 is moved away from the balls to permit the socket to be removed.

A pin having spherical ends could be used instead of the two balls. When the parts are assembled, the balls 18, 20 (or pin) are placed in the cross bore 16 and the ends of the bore are then coined. The spring 54 is then placed inside the sleeve and the slider is "hooked" into place. The loose assembly is then moved onto the cylindrical end of the extension until the reduced diameter end loop of the spring snaps into groove 56. This is a permanent assembly. The only way to now remove the sleeve is to destroy it. The spring limits movement of the sleeve. Sleeve movement to the left is limited by end 60 engaging the spring loop engaged in the groove. Spring movement to the right is limited by front end 58 closing (stacking) the spring loops against the spring loop captured in the groove 56.

Figure 1:
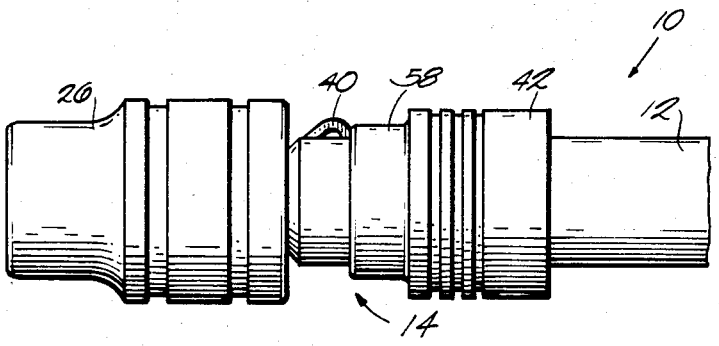
FIG. 1 is a "side" elevation of the present extension connected to a wrench socket.
Figure 2:
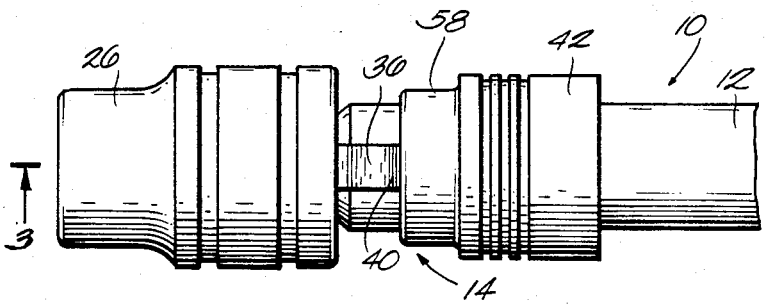
FIG. 2 is an elevation rotated 90° from FIG. 1.
Figure 3:
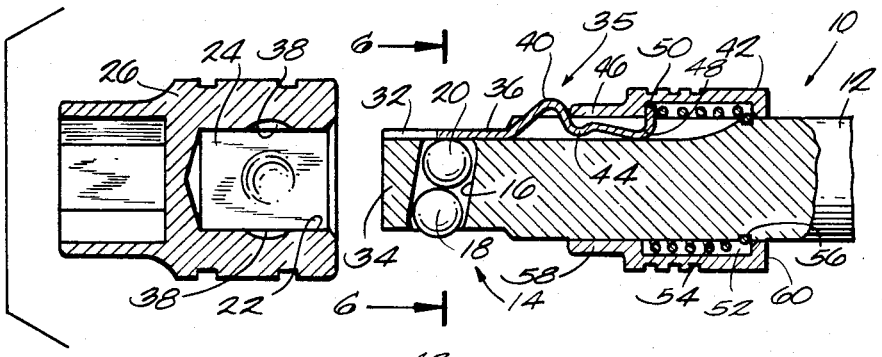
FIG. 3 is a section on line 3—3 of FIG. 2 but with the extension and socket separated.
Figure 4:
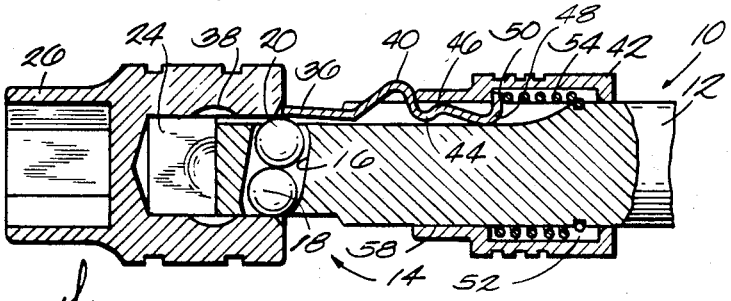
FIG. 4 shows the extension entering the recess in the socket with the sleeve and slider pushed back from the FIG. 3 position.
Figure 6:
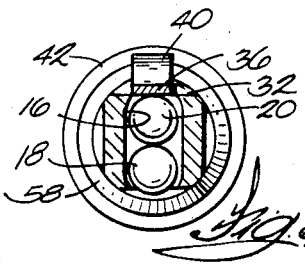
FIG. 6 is a section on line 6—6 in FIG. 3.

Since the tab 36 of the slider 35 can rock upwardly around "pivot" or point 48 the end of the tab can be moved into position to be engaged by the socket. This, coupled with the angle disposition of the cross bore, makes it possible to push the socket onto the extension. Thus, as shown in FIG. 3, the ball 18 projects from the cross bore because tab 36 is biased by spring 54 about point 48 to press down on ball 20. The entry into the socket recess 24 is slightly beveled or chamfered. This will cam the ball 18 (a sharp corner would also cam the ball) to push the balls 18, 20 upwardly and rock tab 36 upwardly about 48. The end of tab 36 will strike the bevel or face of the socket and will push slider 35 to the right relative to the extension as the extension enters the recess. The slider hump 40 engages the sleeve and pushes the sleeve to the right, compressing spring 54 as shown in FIG. 4. When the ball 18 reaches the undercut, the spring 54 forces the slider to the left into the groove to force the balls 18, 20 down so ball 18 engages the undercut 38. This locks the socket in the extension until the sleeve is manually retracted to allow the balls to move into the cross bore and permit the socket to be removed. The socket has been mounted simply by pushing it on the end of the extension.

The illustrated embodiment shows two balls which is typical of a $\frac{1}{2}$"drive. With a $\frac{3}{4}$" drive, three balls can be used. Larger drives would probably use the pin approach.

The push-on feature is a great improvement for the user. The release is simple to operate and is very strong. As a socket on a long extension is moved to the work, the socket generally "protects" against actuating the sleeve to release the socket. As the socket is pulled back, engagement of the sleeve with an obstruction tends to move the sleeve in the locking direction, not in the release direction. Therefore, the user won't leave the socket behind. The socket is released by retracting the sleeve. Another socket is then mounted by pushing the socket and extension together.

It will be noted the slider is effectively connected to the sleeve. The spring biases the slider so the lock tab lies in the bottom of the groove 32. The slider can pivot about 48 to raise the tab. The sleeve can rotate about the extension.

I claim:

1. A socket wrench extension provided with a push-on/quick release locking arrangement comprising, a drive end on said extension having an even number of flat drive surfaces and having an axis, a cross bore through the drive end intersecting opposed flat surfaces, said cross bore having an axis and an end at each of said opposed flat surfaces intersected by said bore, lock means mounted in said bore having a length generally equal to the distance between said opposed surfaces, an axial groove in one of said opposed flat surfaces, the axis of said cross bore being angled relative to a line perpendicular to an axis of the extension so the end of the bore at the other of said opposed surfaces is closer to an end of the extension, means retaining said lock means relative to said bore while allowing limited projection of the lock means to a lock position beyond said other surfaces.

an axially movable sleeve mounted on said extension for movement between a locked position and a released position, said sleeve having an interior groove having front and rear walls, and an end portion located between said drive end and said interior groove a slider mounted in said axial groove and including axially spaced portions engaging said sleeve, one of said axially spaced portions engaging said end portion of said sleeve while the other of said axially spaced portions engages said front wall of said interior groove and forming a junction portion with said slider said slider including a lock tab in said axial groove operative to obstruct movement of said lock means into said groove when the slider is in a locked position whereby the lock means projects from said other of said opposed flat surfaces, said lock tab being retracted from said locked position when said sleeve is moved to its released position whereby said lock tab no longer obstructs said lock means and the lock means can move into the bore, a spring mounted in said interior groove in said sleeve and bearing against said other axially spaced portion of said slider to bias the sleeve and slider to said locked position, said slider being rockably mounted in said axial groove for rocking on said junction portion whereby the lock tab can be raised by said lock means when said lock means is moved into said cross bore.

2. A socket wrench extension according to claim 1 including, an annular groove in the extension near said drive end, a loop of said spring remote from the drive end being engaged in said annular groove, movement of the sleeve toward said drive end being limited by engagement of said rear wall with said spring loop.

3. A socket wrench extension provided with a push-on/quick release locking arrangement comprising, a square drive end on said extension having flat drive faces, a transverse bore through said drive end, lock means mounted in said bore for movement between a lock position in which the lock means projects from one end of the bore and a release position in which the lock means lies within the drive end, said one end of said bore being closer to an end of said drive end than is the other end of said bore, an axial groove in one of said drive faces intersected by said other end of said bore, a slider including a lock tab mounted on the extension for slidable axial movement in said groove between an obstructing position in which said tab holds the lock means in said lock position and a non-obstructing position in which the lock means can move to said release position, said extension having a cylindrical shaft terminating at said drive end, an annular groove in said shaft adjacent said drive end, a sleeve mounted on said shaft and having in-turned ends, said slider being connected to said sleeve by means including an arm projecting radially into the space between said sleeve and said shaft adjacent an end of the sleeve closer to said drive end, said arm being connected to said slider at a junction portion, said spring having a coil engaged in said annular groove and enclosed in said space between the sleeve and the shaft and compressed against said arm to bias the sleeve and slider towards said drive end, said slider being rockable on said junction portion to enable said lock tab to move radially out of said groove when acted on by said lock means moving to said release position.

4. A socket wrench extension in accordance with claim 3 in which the length of the lock means transverse the drive end is generally equal to the space between the opposed faces intersected by the cross bore.

5. A socket wrench extension in accordance with claim 4 in which the spring limits movement of the sleeve.

6. A socket wrench extension in accordance with claim 5 in which said slider is formed to engage said sleeve on each side of the in-turned sleeve end closer to said bore.

7. A socket wrench extension provided with a push-on/quick release locking arrangement comprising, a square drive end on said extension, a transverse bore through said drive end, lock means mounted in said bore for movement between a lock position in which the lock means projects from one end of the bore and a release position in which the lock means lies within the square cross section of the drive end, said one end of said bore being closer to the end of said drive end than the other end of said bore, an axially extending groove intersecting said other end of said bore, a member mounted in said groove for sliding movement between a lock position and a release position, said member including a lock tab having a thickness about equal to the depth of said groove, said lock tab engaging said lock means when said member is in said lock position.

a radial arm projecting from said member, an angled corner between said arm and said member, said member being rockable on said corner to provide a limited range of radial movement of said lock tab enabling said lock tab to be raised above said groove by means of force applied to the tab by said lock means in its said release position, spring means acting on said arm to bias said member to its said lock position and to position said lock tab within said groove, a sleeve enclosing said spring means and engaged by said arm.

8. A socket wrench extension provided with a push-on/quick release locking arrangement comprising, a square drive end on said extension, said square drive end having opposed flat faces, a bore extending on an angle through said drive end and intersecting a pair of opposed flat faces so one end of the bore is closer to the end of the drive end then is the other end of said bore, lock means mounted in said bore for movement between a first position in which said lock means lies between said pair of faces and a second position in which said lock means projects from one face of said pair, a groove in the other face of said pair, a lock tab slideably mounted in said groove for axial movement between a lock position overlying said bore and a release position in which it does not overlie said bore, said lock tab being a part of a slider, said slider having a heel portion remote from said lock tab and being mounted in said groove to rock on said heel portion to enable said lock tab to be lifted out of said groove, spring means biasing said slider to move said lock tab to said lock position and into said groove, and an actuating sleeve enclosing said spring means and engaging said slider.

* * * * *